US006000186A

United States Patent [19]

Fielding et al.

[11] Patent Number: 6,000,186

[45] Date of Patent: Dec. 14, 1999

[54] DRYWALL CONSTRUCTION AND MEANS THEREFOR

[76] Inventors: David W. Fielding, 131 Yonge Blvd., Toronto, Ontario, Canada, M3S 3H2; Clifford E. Van Steinburg, 48 Catalina Dr., Scarborough, Ontario, Canada, M1M 1K6

[21] Appl. No.: 08/976,229

[22] Filed: Nov. 21, 1997

[30] Foreign Application Priority Data

Dec. 5, 1996 [CA] Canada ..... 2192123
Nov. 19, 1997 [CA] Canada ..... 2220743

[51] Int. Cl.[6] ..... E04B 2/16; E04B 2/18

[52] U.S. Cl. ..... 52/564; 52/565; 52/396.09; 52/396.08; 52/586.1; 52/604; 52/747.12

[58] Field of Search ..... 52/396.09, 396.08, 52/564, 565, 586.1, 749.13, 747.12, 742.16

[56] References Cited

U.S. PATENT DOCUMENTS

| | | | |
|---|---|---|---|
| 2,006,462 | 7/1935 | Kupper . | |
| 2,199,112 | 4/1940 | O'Leary . | |
| 2,687,034 | 8/1954 | Blanc | 52/396.08 X |
| 2,708,359 | 5/1955 | Henry | 52/396.08 |
| 2,869,356 | 1/1959 | Kulhavy et al. | 52/396.09 |
| 3,099,110 | 7/1963 | Spaight | 52/396.09 |
| 3,902,296 | 9/1975 | Thomas | 52/747.12 |
| 4,426,815 | 1/1984 | Brown . | |
| 4,899,512 | 2/1990 | DeGooyer | 52/396.08 |
| 4,986,048 | 1/1991 | McMarlin | 52/396.09 X |
| 5,048,250 | 9/1991 | Elias . | |
| 5,485,702 | 1/1996 | Sholton | 52/396.09 X |
| 5,694,730 | 12/1997 | Del Rincon et al. | 52/586.1 |
| 5,802,792 | 9/1998 | Fielding et al. | 52/396.09 |

FOREIGN PATENT DOCUMENTS

| | | | |
|---|---|---|---|
| 609789 | 11/1960 | Canada | 52/396.09 |

*Primary Examiner*—Robert Canfield
*Attorney, Agent, or Firm*—Clifford E. Van Steinburg

[57] ABSTRACT

A drywall construction simulates a mortared block or brick wall construction by the use of simulated horizontal mortar layer inserts between the layers of building blocks and vertical inserts between abutting end surfaces of blocks in each layer, the horizontal layer insert being in the form of a belt, the belt layer being substantially non-compressible and the vertical inserts being provided with parts which extend across the space between abutting block surfaces of a wall construction and into slots provided in the abutting surfaces to secure interconnection and alignment of block ends and simulate vertical mortar inserts between vertical and abutting surfaces, the inserts may be provided with flanges or protrusions which cooperate with holes or grooves in underlying or overlying belt layers to secure the inserts, and the block surfaces, cooperating therewith, against lateral movement with respect to the layers, the belts or both.

6 Claims, 4 Drawing Sheets

5

DRYWALL CONSTRUCTION AND MEANS THEREFOR

FIELD OF THE INVENTION

This invention relates to block-type drywall construction and, more particularly to a brick drywall construction method and the means for carrying it out and is related to the invention described and claimed in Applicants' Canadian patent applications 2,158,771 filed Sep. 21, 1995 and 2,192,123 filed Dec. 5, 1996, the latter constituting a part of the present application.

Although the method and means are applicable to building blocks in general, i.e. bricks and concrete blocks, the construction is preferably of brick. The constructed wall is designed to be, essentially, self supporting and simulate the appearance of a brick wall of normal mortared construction.

DISCUSSION OF THE PRIOR ART

Drywall construction is used generally for low walls and takes the form of a wall constructed of unitary building units or blocks which can be stacked to provide a self supporting wall structure, a securing cement, or mortar, being dispensed with.

U.S. Pat. No. 5,048,250—Ellias, issued Sep. 17, 1991, is directed to a building block per se which is designed for stacking in a drywall structure. The blocks are provided with vertically oriented holes, which in stacking are vertically aligned through row layers, through which rods may be passed to provide reinforcement of the structure.

U.S. Pat. No. 4,426,815—Brown, issued Jan. 26, 1984, is directed to a mortarless concrete building block provided with key means locking one layer of blocks to the underlying or overlying next layer. Here again reinforcing rods may be used for added strength.

U.S. Pat. No. 2,199,112—O'Leary, issued Apr. 30, 1940, is directed to an insulated building block having, in one instance, a simulated brick construction surface being applied to the face of the block.

U.S. Pat. No. 2,006,462—Kupper, issued Jul. 2, 1935, is directed to a miniature building system wherein individual building blocks are mounted on and secured by vertical rods passing consecutively through layers of the blocks.

GENERAL DESCRIPTION OF THE INVENTION

The present invention is directed to a drywall construction method and means facilitating ease of construction while, at the same time, providing a strong structure with the appearance of a mortared block wall. The preferred construction block is a standard size brick modified somewhat to accommodate the features of the present invention.

According to the invention described in Canadian patent application 2,158,771, supra, the layers of brick, in regular construction format, are interleaved with relatively thin layers of belt-like material which provides the appearance of a mortar strip between the layers. The standard construction brick, upon which the present description is primarily based, is provided with holes, usually three, passing vertically through the brick with the holes symmetrically situated so that the holes of offset brick layers will align between layers with, in the case of the three hole brick, the centre hole coinciding vertically with the butting ends of the bricks in the layers immediately above and below that particular centre hole. A mating hole structure is provided in the belt-like material. Simulated vertical mortar pads are inserted between abutting brick ends.

A particular feature of the invention of the aforementioned application is the use of short pin members, for instance tubes, which are dimensioned to fit snugly into the holes in the brick and the belt. The length of the pin member is preferably substantially equal to the vertical height of a brick and is inserted into the hole of a brick to the approximate extent of half its length, the other half of the pin member acting as a locating pin upon which the subsequent layer of simulated mortar and bricks are laid. The pin members act as means for securing the brick and belt layers against horizontal displacement with respect to each other. In addition, the pins, in view of their snug fits in the brick holes, provide an additional degree of vertical stability. When the pins are tubular in form, vertical reinforcing rods may be readily inserted through a number of laid layers of bricks and insulating belts.

This type of construction reduces labour costs in the building of walls etc., is economical and, in view of the fact there are no rigid joints the wall may be subjected to considerable vibrational stress without consequent cracking and deterioration thus rendering the construction useful for earthquake prone areas.

The present invention is concerned with the inserts between the ends, or the abutting surfaces, of the bricks in a horizontal layer which are utilized to align and maintain the alignment of brick ends in the horizontal layers. In addition, the inserts may act as a means of securing the brick rows against lateral movement between the bricks and the belt layers between the bricks.

To this end the inserts are provided with vertical flanges which extend horizontally into slots provided in the abutting surfaces, usually ends, of the bricks of a row. In this case the inserts are of firm material and act as joining and alignment strips between brick ends when inserted into facing slots on the brick ends, the slots providing a close fit for the inserts. In one form of the invention, there are two inserts, one near each outside edge of the abutting brick ends, which inserts are of such a length, in the horizontal direction of the brick row, to maintain separation of the bricks and provide a portion which appears as being the vertical mortar strip between abutting brick surfaces. In another form of the invention only one insert is used between abutting brick surfaces.

In order to provide security between the bricks and the horizontal belts, grooves can be provided in the belt to accept the top and bottom edges of the inserts to assist in maintaining alignment between the belts and the brick rows. The belts can be provided with thickened outer edge parts which are provided with bottom and top surfaces grooved to accommodate the upper and lower longitudinal edges of the inserts. In an alternate form the inserts can be provided with extended flanges which, for instance protrude upward and downward, respectively, to hook over the thickened outer parts of the belt, preferably the inside edges of the thicker parts. It is contemplated that pins, as mentioned above, may be used to provide further security.

DESCRIPTION OF THE PREFERRED EMBODIMENT

Figure 1:
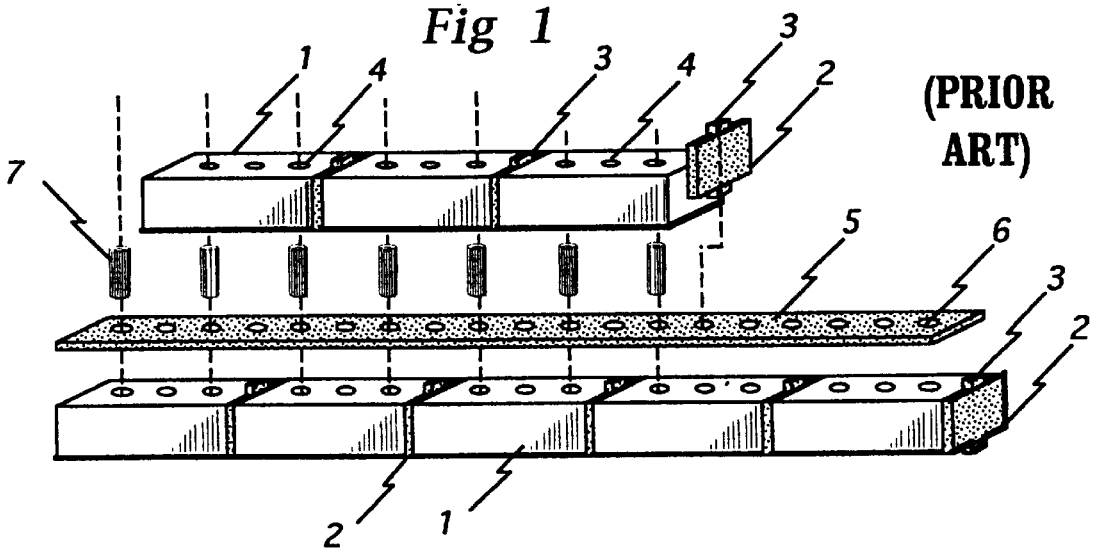
FIG. 1 shows an exploded view of a brick drywall construction according to the invention described and claimed in Canadian patent application 2,158,771.

Referring to FIG. 1, which shows an exploded view of the brick or block wall as described in Canadian patent application, 2,158,771, two horizontal rows of bricks 1, are laid end to end in standard brick wall construction, in horizontally offset position whereat the abutment of two bricks in the upper layer overlies the centre of a brick in the layer immediately below. The bricks, in this instance, are provided with a longitudinal series of three equally spaced and longitudinally separated holes 4 which pass vertically through the brick, the centre hole of the series being located centrally of the brick and the longitudinal spacing of the holes is such that, if the series of holes was continued, the subsequent hole centre-lines would substantially coincide with the central position between abutting end surfaces of the bricks in a layer.

The bricks of each row are horizontally separated by an insert 2 having the dimensions of a mortar separation layer. The inserts simulate the appearance of mortar and may be colored as desired. The insert is, preferably, provided with centrally located, rectangular, upper and lower extensions 3 which are designed so that the horizontal dimensions thereof substantially equal the diameter of the vertical holes 4 in the bricks 1.

A belt 5, having a simulated mortar appearance and colored as desired, is provided with a longitudinal series of holes 6 which are longitudinally spaced in accordance with the spacing of the holes in the brick 1 and have diameters equal to that of the holes in the brick. The belt 5 is laid between the layers or rows of bricks 1 with the holes 6 of the belt overlying the holes 4 of the bricks. The longitudinal spacing of the holes in the brick are such that, when the bricks are laid in standard horizontal-row construction format, the centre hole of a brick will coincide, longitudinally of the row, with the centre of the abutment spaces of the rows of bricks immediately above and below that centre hole. As a consequence, the belt 5, when positioned on a brick row will have holes therein which coincide with the abutment spaces of that row. The purpose of the extensions 3 on the inserts 2 will now become apparent since the belts 5 and the bricks 1, above and below an insert 2, will provide holes 6 and 4 which will accept the extension 3 of the insert 2. The insert 2 is, accordingly, secured between the belt layers 5 by the extensions 3. Although the extensions 3 could be dispensed with, it is preferred that they are present to secure the inserts 2 in position.

In order to secure the belts in position between brick layers and provide stability to the construction, pins 7 are provided. The pins 7, preferably, have a diameter substantially equal to that of the holes 4 and a length approximating the thickness of a one layer of bricks 1 and one layer of belts 5. The pins 7, preferably, have, at least, a somewhat resilient surface, or are split longitudinally, whereby slight imperfections in the brick holes 4 will not prevent a pin 7 from entering thereinto. In constructing a wall, the pins 7, are tapped through a belt layer into the brick layer below leaving approximately one half the pin length projecting above the belt. In this manner the belts and brick layers are secured, by the pins, against horizontal movement with respect to each other.

The above mentioned Canadian patent application should be referred to for further information on this particular construction.

Figure 2:
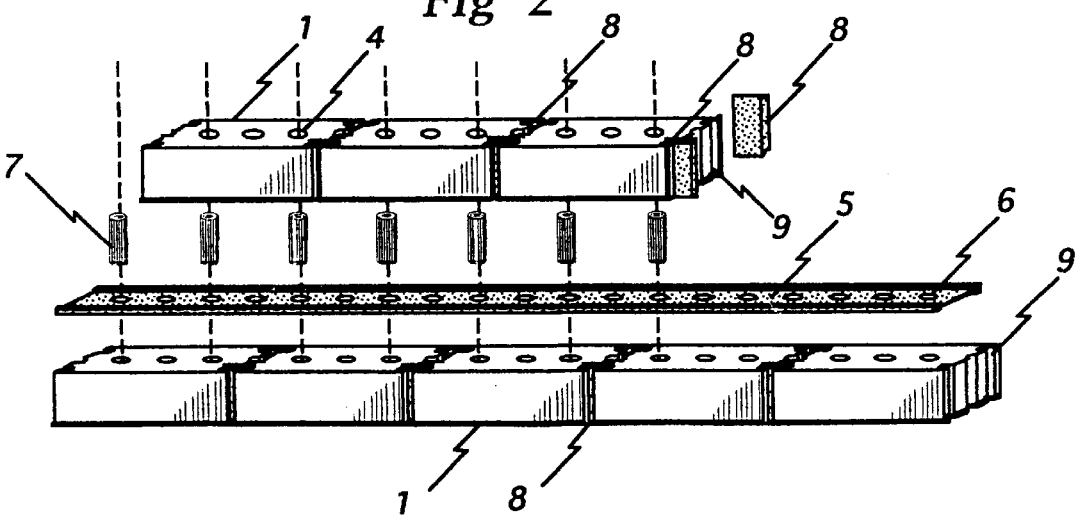
(PRIOR ART) Fig 2
FIG. 2 shows an exploded view of a brick drywall construction utilizing the features of the present invention.

Referring now to FIGS. 2 to 11 inclusive, which depict features of the present invention, FIG. 2 shows a construction similar to FIG. 1 with the exception that the vertical inserts 2 have been substituted for by flat rectangular plates 8 which are notched into rectangular recesses or slots 9 provided in the abutting end surfaces of the bricks of a horizontal layer. The vertical outer sides of the inserts 8 are positioned to coincide with the normal mortar fill between the brick ends to simulate normal mortared brick construction appearance.

Figure 3:
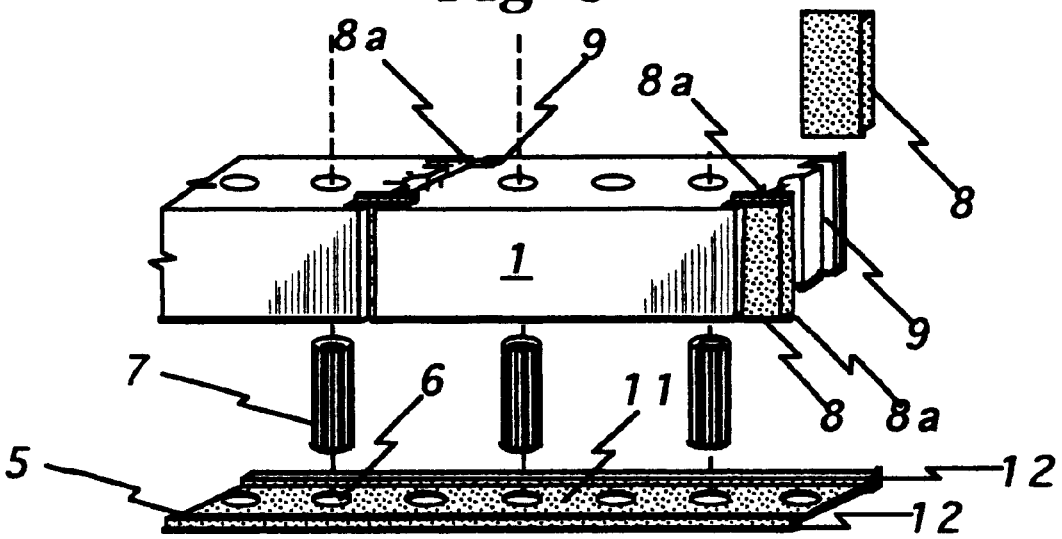
FIGS. 3 shows an exploded and enlarged view, of a portion of FIG. 2, showing more clearly one form of the insert according to the present invention.

FIG. 3 shows a form of the invention in greater detail. Inserts 8 are notched into the brick-end slots 9 and it will be apparent that when so notched into facing brick-ends the brick-ends will be held in alignment providing the inserts 8 are of relatively rigid material, which is preferably the case. In order to economize in the material required for the belts 5, the belt may take the form of a thin central web 11 having thickened, rectangular in cross-section, outside edge parts 12 which, preferably, protrude above and below the web 11, upon which the brick 1 rests when laid on a belt 5. The inserts 8 are provided with inside, upper and lower edge, extensions 8*a*, 8*a*, which overlap the inside edges of parts 12 of belt 5. The extensions provide lateral movement security between belts 5 and brick 1 when both ends of the bricks are so secured. A clearer view of the insert configuration is provided in FIG. 5. Pins 7 can be used for additional security to prevent relative movement between the belts 5 and brick 1 rows.

Figure 4:
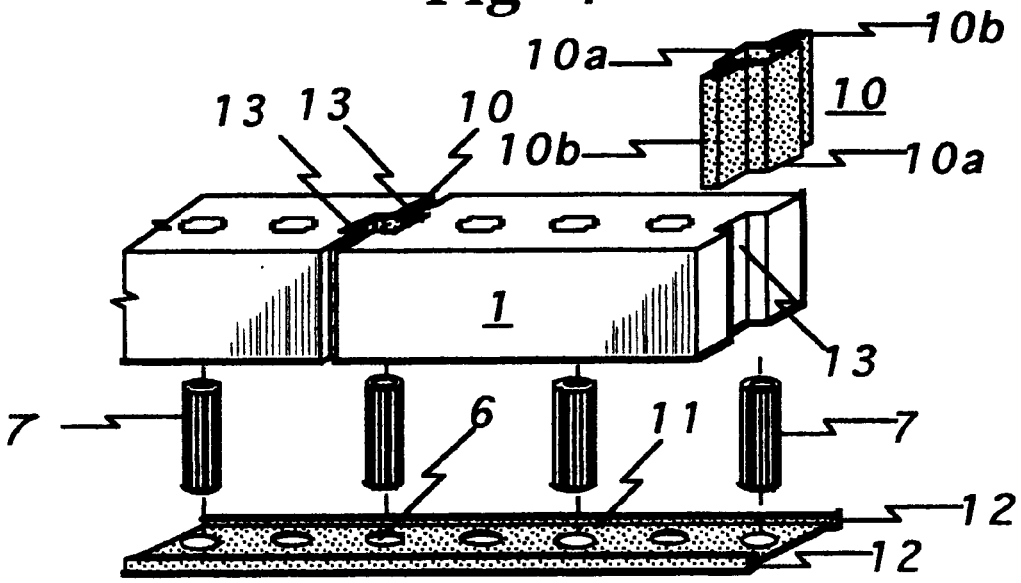
FIG. 4 shows an exploded and enlarged view, of a portion of construction showing more clearly a modified form of insert.

In a further embodiment, as shown in FIG. 4, the inserts are integrated into a tubular unit 10 in a cross configuration in cross-section. In this configuration an opposed pair of the arm parts 10*a* are close fitted into slots 13 provided, singly, in the facing brick-end surfaces, whereas the other pair of arms 10*b* of the cross form the simulated, vertical mortar strips of a brick wall construction. A particular advantage of this unitary construction is that it is tubular in form and can be economically extruded.

It is feasible to provide the opposed arm pairs 10*a*, 10*b* in equal widths but, it is believed that the wider arms, with sides spaced to permit the entry of a pin 7 therebetween, has a particular advantage if it is desired to use pins 7 at the cross locations as shown.

It is preferable to over and undercut the narrow cross ends 10*b* so that the wider arms will sit between the protruding portions 12 of the belt 5 to laterally secure the belt, the facing bricks and the cross construction with respect to each other.

Figure 6:
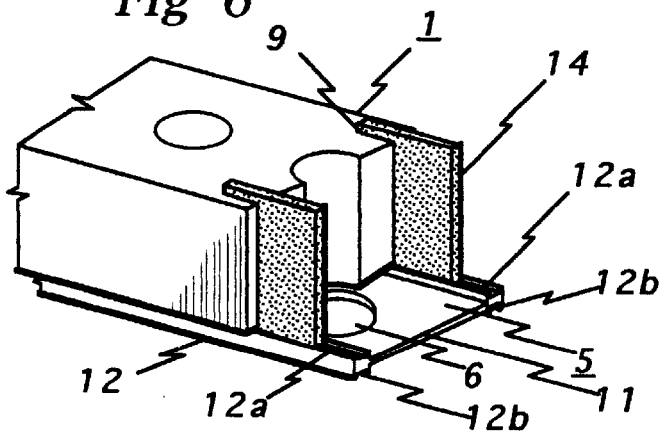

Referring now to FIG. 6, a modified form of an insert 14 is shown in the form of a thin, rectangular-in-cross-section, plate 14 which is close fitted into accommodating slots 9 provided in abutting brick 1 surfaces. This is a very economical form of insert. However, in order to provide security, in this instance, the parts 12, of belt 5, should be provided with grooved upper and lower surfaces 12*a*, 12*b*, into which slightly extended upper and lower ends of the inserts seat to provide lateral security.

Figure 7:
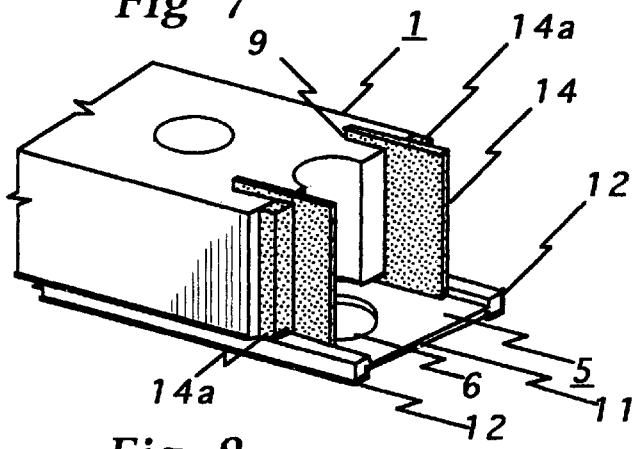

FIG. 7 shows a modified form of the inserts of FIG. 6 wherein the inserts are in the form of plate parts 14 with rectangular protrusions 14*a* which are designed to sit between the brick ends to simulate the mortar appearance while the plate parts 14, protruding into the brick slots 9 and lying between belt edge parts 12, provide the alignment and security. This construction allows the slot 9 to be placed further from the outside surface of the brick and provides a more robust construction.

Figure 5:
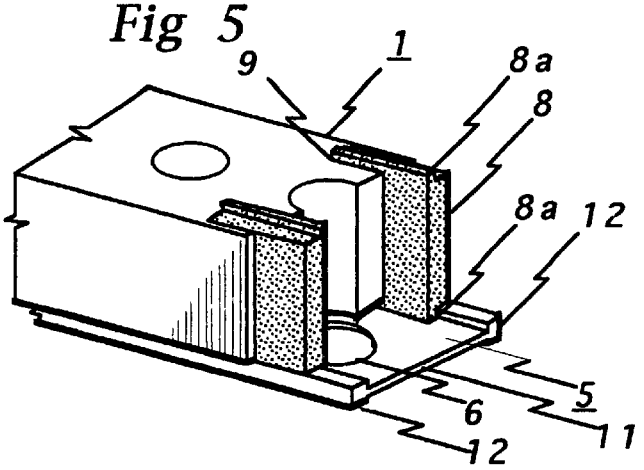
FIGS. 5, 6, and 7 show, in greater detail, alternate forms of inserts which may be used according to the invention.
Figure 8:
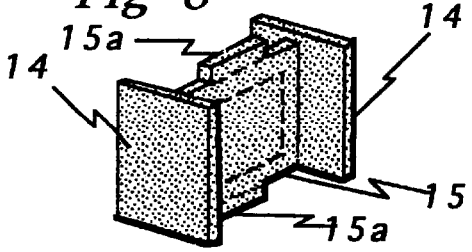
FIG. 8 shows a form of an integrated insert unit.

FIG. 8 shows a further modification of the insert, according to the present invention, wherein two insert parts 14, corresponding to similarly numbered parts in FIG. 5, 6 or 7 are integrated into a unitary construction by an interconnecting web 15. The particular advantage of this construction is the extra security provided by the unitary construction and the ease of use since two inserts are inserted simultaneously. The web 15 may be provided with extensions 15*a* which can be inserted into the underlying and overlying brick and belt holes in a constructed wall thus securing the inserts with respect to the bricks and the belt which is provided with holes coinciding with the holes in the bricks. The extensions 15*a* may be removed from the joining web 14 along the dashed line. Furthermore, if it is desired to save weight and material the central area of the web, shown in dashed outline, need not be present.

Figure 9:
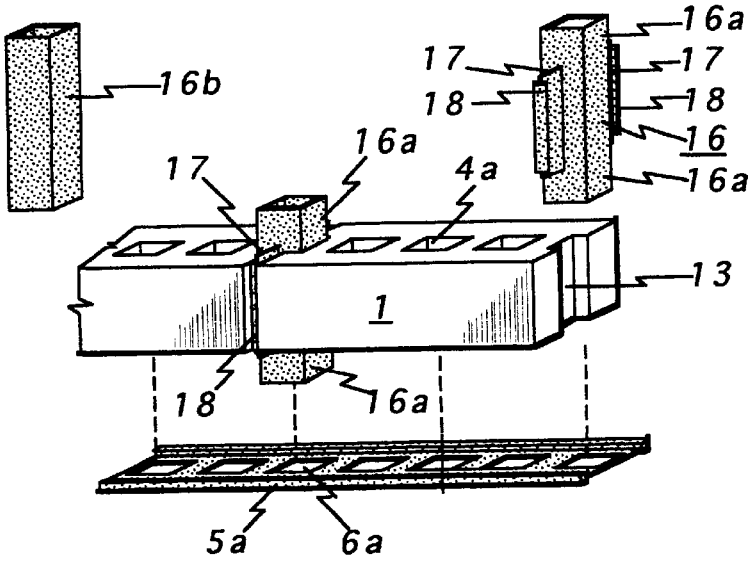
FIG. 9 shows a form of a drywall construction related to the construction shown in FIG. 4.

Referring now to FIG. 9, a modified form of construction, related to that of FIG. 4, is shown. In this construction the insert 10 has been substituted for by a modified insert 16 which is, preferably, rectangular in cross-section and tubular. In addition, for increased security of construction and economic reasons, the pins 7, of FIG. 4, are substituted for by extensions (pins) 16*a* of the insert 16 to form an integrated insert-pin combination 16, 16*a*. In order to accommodate the pin parts 16*a*, the holes 4, provided in the bricks may be rectangular in cross section and dimensioned to provide a snug fit.

Figure 10:
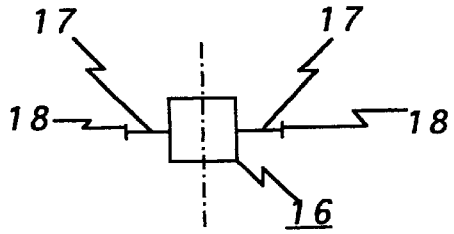
FIGS. 10 and 11 show plan and end views, respectively, of the insert used in the construction according to FIG. 9.
Figure 11:
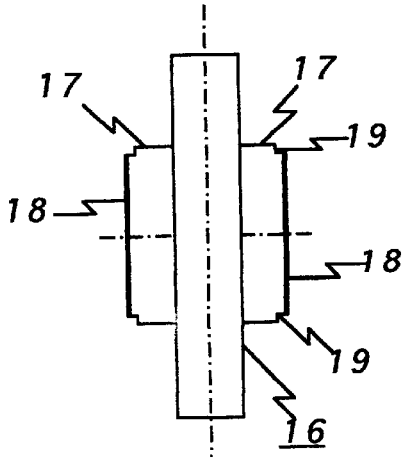

As best shown in FIGS. 10 and 11, the insert 16 is provided with vertically oriented, rectangular and lateral wing-like, flanges 17 midway of the ends of the insert 16, The flanges 17 are designed to extend between abutting surfaces of brick ends, as shown in FIG. 8, and vertically-narrow end plates 18 are provided, at right angles to the flanges 17, to simulate the vertical mortar between brick ends. The flanges 17 are, preferably, notched at the outer corners 19 so that the flanges 17 will fit between the protrusions 12 of the belt 5*a*, FIG. 8. The bricks 1 and the belts 5*a* are provided with rectangular holes 6*a* to accommodate the rectangular extensions 16*a*. In the construction shown in FIG. 8, the bricks may be held in position by using only the inserts 16 between abutting brick ends and the pin parts 16*a* will protrude through belts 5*a* into the center holes of bricks in the layers immediately below and above the layer in which the inserts are inserted into brick end surfaces. For further security, pins 16*b*, not provided with lateral extensions 17, may be utilized at brick-hole locations other than where the integrated inserts are employed.

Although preferred embodiments of the invention have been described further variations and modifications may be made without departing from the spirit and scope of the invention which is defined in the claims appended hereto.

We claim:

1. A drywall construction comprising;

a plurality of vertically-stacked horizontal rows of bricks, the bricks of each row being laid in spaced, end-to-end abutting, relationship, with the bricks of vertically adjacent rows being symmetrically offset with respect to each other, the bricks each having an upper and lower surface provided with, at least, a centrally located hole extending from the upper surface to the lower surface thereof and, at least, one vertically oriented end-slot facing a symmetrically opposite end-slot in the end of a horizontally adjacent and abutting brick in the same row, a plurality of horizontal, mortar simulating, belts one of which is laid longitudinally between each two vertically-adjacent rows of bricks, each belt being provided with a series of centrally located holes spaced longitudinally of the belt to coincide consecutively with the holes of each brick and the abutment spaces between the bricks in the said two rows, spacers, each inserted into opposed vertical end slots of horizontally abutting bricks to longitudinally space the abutting bricks and provide simultaneously, side surfaces simulating the appearance of vertical mortar strips between the abutting bricks, each spacer being provided with upper and lower extensions adapted to mate with accommodating surfaces of belts adjacent the upper and lower surfaces of the abutting bricks with which the spacer is associated to maintain the said abutting bricks against lateral movement with respect to the said belts adjacent, wherein each belt is provided with at least one longitudinal groove into which the extensions of the spacers seat to secure a row of bricks against lateral movement with respect to the belt.

2. A drywall construction as claimed in claim 1 wherein short pins are provided extending vertically from holes in the bricks of a row through the holes in a belt and into, longitudinally coincident, accommodating holes in bricks in a vertically displaced row.

3. A drywall construction as claimed in claim 1 wherein the upper and lower extensions of the spacers are in the form of pins which extend through the holes of immediately vertically adjacent belts and into coincident holes provided in the bricks of immediately vertically adjacent, upper and lower, rows of bricks.

4. A drywall construction comprising;

a plurality of vertically-stacked horizontal rows of bricks, the bricks of each row being laid in spaced, end-to-end abutting relationship, with the bricks of vertically adjacent rows being symmetrically offset with respect to each other, the bricks each having an upper and lower surface provided with, at least, a centrally located hole extending from the upper surface to the lower surface thereof and, at least, one vertically oriented end-slot facing a symmetrically opposite end-slot in the end of a horizontally adjacent and abutting brick in the same row, a plurality of horizontal, mortar simulating, belts one of which is laid between each two vertically-adjacent rows of bricks, each belt being provided with a series of centrally located holes spaced longitudinally of the belt to coincide consecutively with the holes of each brick and the abutment spaces between the bricks in the said two rows, spacers inserted into opposed vertical end slots of horizontally abutting bricks to space the said abutting bricks and provide simultaneously, side surfaces simulating the appearance of vertical mortar strips between the said abutting bricks, the spacers being provided with upper and lower vertical extensions extending through, respectively, the holes of the belts, immediately above and below a row of bricks, being spaced by the spacers, into the holes provided in the immediately vertically adjacent, upper and lower, rows of bricks to maintain the spaced bricks of the said row against lateral movement with respect to the belts and rows of bricks immediately adjacent the upper and lower surfaces of the said spaced bricks.

5. A drywall construction as claimed in claim 4, wherein the upper and lower extensions of the spacers are in the form of centrally located pins which pins extend through the holes of immediately vertically adjacent belts and into the coincident holes provided in the bricks of immediately adjacent, upper and lower, rows of bricks, the vertical end slots, provided in the bricks, being located centrally of the brick ends.

6. A drywall construction as claimed in claim 4, wherein the spacers comprise pins which extend through the holes of immediately adjacent belts and into coincident holes provided in immediately adjacent, upper and lower, rows of bricks, the pins each being partially accommodated in a pair of opposed end slots of two abutting bricks, the vertical end slots of each brick being centrally located in the brick end and each pin being provided with side extensions which simulate the vertical mortar strips between the bricks being spaced by the spacers.

* * * * *